US008042195B1

(12) United States Patent
Massey

(10) Patent No.: US 8,042,195 B1
(45) Date of Patent: Oct. 25, 2011

(54) COMBINATION BEACH TOWEL AND CHANGING ENCLOSURE

(76) Inventor: Kathleen N. Massey, Hillsboro, TN (US)

( * ) Notice: Subject to any disclaimer, the term of this patent is extended or adjusted under 35 U.S.C. 154(b) by 98 days.

(21) Appl. No.: 12/477,648

(22) Filed: Jun. 3, 2009

Related U.S. Application Data

(63) Continuation-in-part of application No. 12/047,801, filed on Mar. 13, 2008, now abandoned.

(60) Provisional application No. 60/938,495, filed on May 17, 2007.

(51) Int. Cl.
*A41D 13/00* (2006.01)

(52) U.S. Cl. ..... 2/69.5; 2/69

(58) Field of Classification Search ..... 2/69, 69.5, 2/79, 85, 95, 93, 80, 83, 88
See application file for complete search history.

(56) References Cited

U.S. PATENT DOCUMENTS 1,508,852 A * 9/1924 Moses ..... 2/114
2,344,010 A * 3/1944 Walsh ..... 2/69
2,420,344 A * 5/1947 Cook ..... 2/69
2,931,043 A * 4/1960 Achner ..... 2/69.5
3,013,274 A * 12/1961 Dike ..... 2/69
3,079,611 A * 3/1963 Boryszewski ..... 2/89
3,176,315 A * 4/1965 Freund ..... 2/69
3,288,157 A * 11/1966 Szkolny ..... 135/95
3,381,306 A * 5/1968 Innes ..... 2/69
3,812,539 A * 5/1974 Muehlberg et al. ..... 2/69.5
4,067,066 A * 1/1978 Bruno ..... 2/105
4,347,629 A * 9/1982 Itoi ..... 2/108
6,185,743 B1 * 2/2001 Mick ..... 2/84
6,708,343 B1 * 3/2004 Ceron ..... 2/88

* cited by examiner

*Primary Examiner* — Gloria Hale
(74) *Attorney, Agent, or Firm* — Kenneth L. Tolar

(57) ABSTRACT

A combination privacy enclosure and beach towel includes a hollow sleeve formed of a front panel and a rear panel each having two opposing side edges that are joined to the corresponding side edges of the other panel. The top end of the sleeve includes a small neck opening for receiving a wearer's head while the bottom end of the sleeve is completely open. The sleeve is flattened to form a dual-layer beach towel. To form a privacy enclosure for changing clothing, a user inserts his or her head through the neck opening and drapes the sleeve over the user's body. To convert the device to a tote bag, each end of the sleeve is bundled and an accompanying shoulder strap is secured thereto.

2 Claims, 2 Drawing Sheets

COMBINATION BEACH TOWEL AND CHANGING ENCLOSURE

CROSS REFERENCE TO RELATED APPLICATIONS

This application is a continuation-in-part of application Ser. No. 12/047,801, filed Mar. 13, 2008 now abandoned, and is entitled to the benefit of provisional application No. 60/938,495 filed on May 17, 2007, the specifications of which are incorporated herein by reference.

BACKGROUND OF THE INVENTION

The present invention relates to a beach towel that can be quickly and easily converted into a changing enclosure or an accessory bag.

DESCRIPTION OF THE PRIOR ART

When at a beach or a swimming pool, a swimmer or sunbather must often remove or change clothing. However, changing rooms, restrooms or other privacy enclosures are not always available on many public beaches. If such enclosures are available, they are typically unsanitary, crowded and uncomfortable. Accordingly, there is currently a need for a device that allows a user to quickly and conveniently change clothes whenever conventional privacy enclosures are unavailable or unsuitable. The present invention addresses this need by providing a beach towel that can be quickly and easily converted into a changing enclosure.

SUMMARY OF THE INVENTION

A combination privacy enclosure and beach towel includes a hollow sleeve formed of a front panel and a rear panel each having two opposing side edges that are joined to the corresponding side edges of the other panel. The top end of the sleeve includes a small neck opening for receiving a wearer's head while the bottom end of the sleeve is completely open. The sleeve is flattened to form a dual-layer beach towel. To form a privacy enclosure for changing clothing, a user inserts his or her head through the neck opening and drapes the sleeve over the user's body. To convert the device to a tote bag, accessories are placed within the sleeve interior and each end is bundled. An accompanying strap includes an adjustable loop at each end that is attached to each of the bundled ends thereby sealing the sleeve; the strap also allows the sleeve and the enclosed contents to be easily transported on a user's shoulders.

It is therefore an object of the present invention to provide a portable privacy enclosure for a swimmer.

It is another object of the present invention to provide a beach towel that can be quickly and easily converted into a privacy enclosure or an accessory bag.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
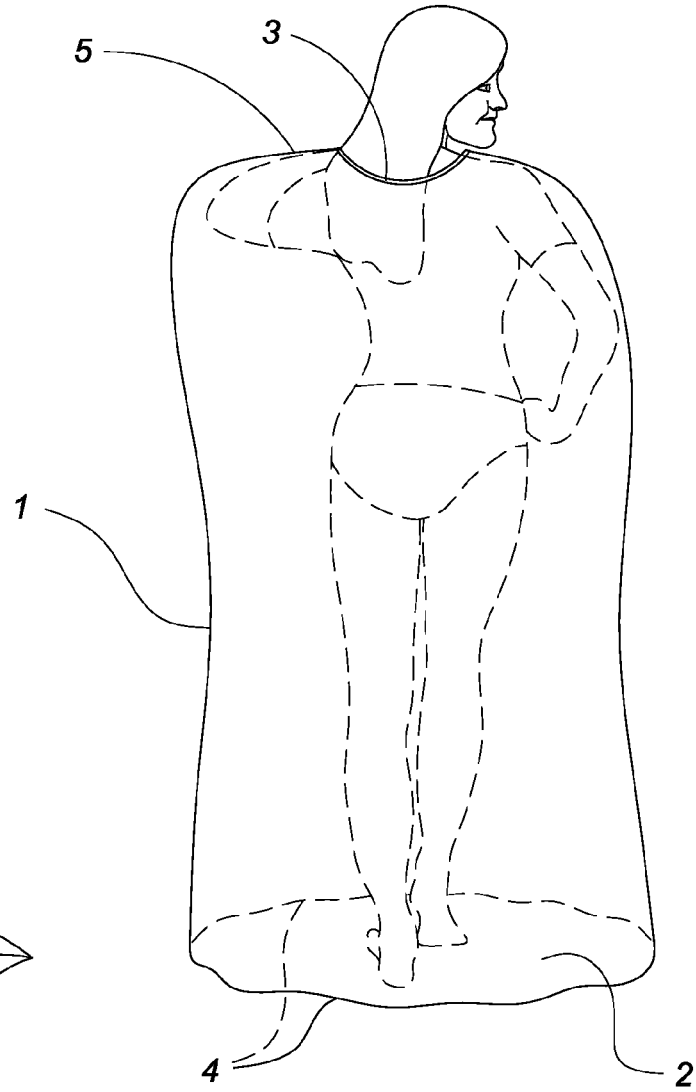
FIG. 2 depicts the device being used as a privacy enclosure.

The present invention relates to a combination beach towel and changing enclosure. The device comprises a hollow sleeve 1 having an open lower end 2 and a substantially closed upper end 5; the sleeve is formed of a front panel and a rear panel each having a top edge, a bottom edge and two opposing side edges. Both the front and rear panels are preferably constructed with a soft, terrycloth-type fabric or any other similar material that is typically used to construct beach towels. Each side edge of the front panel is joined with the corresponding side edge of the rear panel while the bottom edges 4 of the two panels are completely detached to form the open bottom; the top edge of the front panel is partially joined with the corresponding top edge of the rear panel while a central portion of each top edge is free thereby forming a neck opening 3.

The device further includes an accompanying shoulder strap 6 that converts the sleeve to a tote bag. The strap is formed of a wide-profile pad 7 having two opposing ends; coaxially extending from each end is a band 8 having a D-ring 9 or an O-ring at a distal end.

Figure 1:
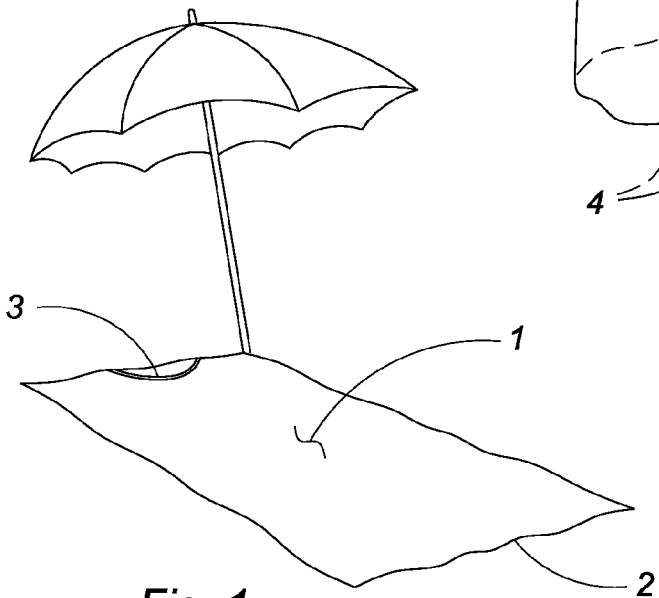
FIG. 1 depicts the sleeve flattened to form a beach towel.
Figure 3:
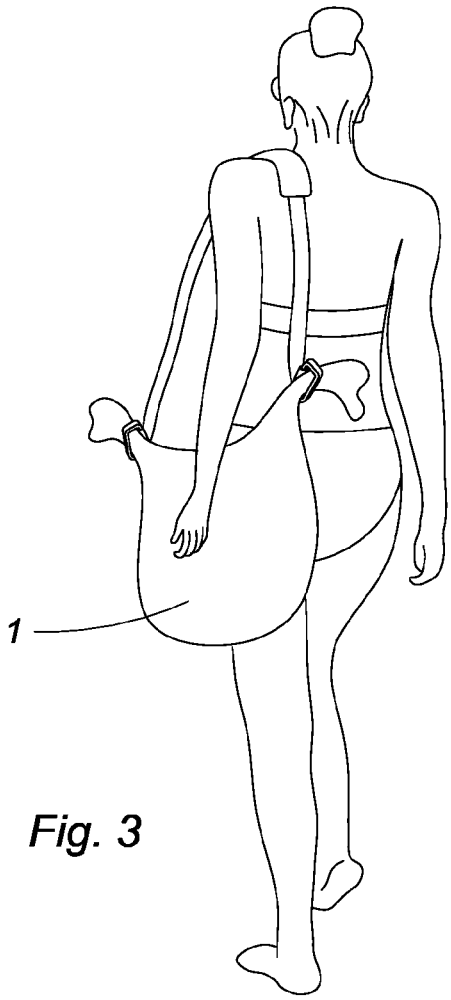
FIG. 3 depicts the device being used as a tote bag.
Figure 4:
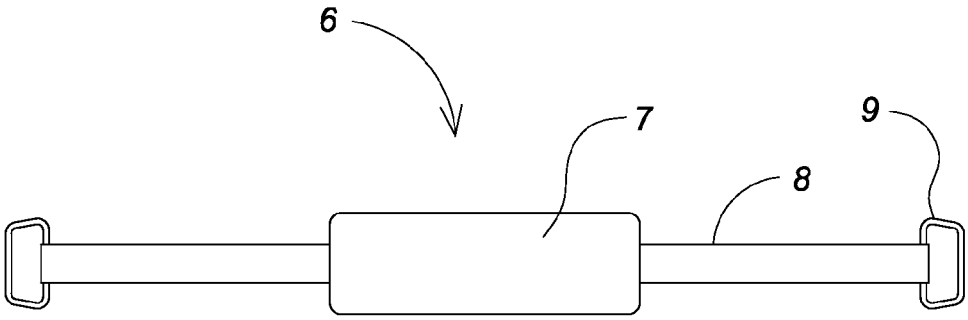
FIG. 4 is a plan view of the shoulder strap.

The sleeve is flattened to form a dual layer beach blanket as depicted in FIG. 1. To form a privacy enclosure for changing clothing, a user inserts his or her head through the neck opening and drapes the sleeve over the user's body as depicted in FIG. 2. The device can also be converted to an accessory bag by placing accessories within the sleeve interior and bundling the upper and lower ends to form an enclosure. A portion of each band is threaded through the adjacent D-ring to form a loop. Each loop is placed about one of the bundled ends and the bands are pulled taut thereby sealing the sleeve and its contents. The strap is placed over the shoulder allowing the sleeve to be conveniently transported as depicted in FIG. 3.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A combination beach towel and changing enclosure comprising:

a hollow sleeve constructed with a soft fabric having an open lower end and a substantially closed upper end, said sleeve dimensioned to substantially enclose a user's body, said sleeve formed of a front panel and a rear panel, each of said front panel and said rear panel having a top edge, a bottom edge and two opposing side edges, each side edge of the front panel joined with the side edge of the rear panel, the bottom edge of the front panel and the bottom edge of the rear panel being free thereby forming the open lower end, the top edge of the front panel partially joined with the top edge of the rear panel, a central portion of the top edge of the front panel and the rear panel being detached to form a neck opening;

a shoulder strap for converting the sleeve to a tote bag, said strap having two opposing ends;

means for attaching each of said opposing ends to said upper end and said lower end of said sleeve whereby said strap transforms said sleeve into a tote bag.

2. A combination beach towel and changing enclosure comprising:

a hollow sleeve constructed with a soft fabric having an open lower end and a substantially closed upper end, said sleeve dimensioned to substantially enclose a user's body, said sleeve formed of a front panel and a rear panel, each of said front panel and said rear panel having a top edge, a bottom edge and two opposing side edges, each side edge of the front panel joined with the side edge of the rear panel, the bottom edge of the front panel and the rear panel being free thereby forming the open lower end, the top edge of the front panel partially joined with the top edge of the rear panel, a central portion of the top edge of the front panel and the rear panel being detached to form a neck opening;

a shoulder strap formed of a wide-profile pad having two opposing ends;

a first band extending from one of the ends of said pad, said first band having a distal end with a first ring attached thereto;

a second band extending from another of the ends of said pad, said second band having a distal end with a second ring attached thereto;

said first band threaded through said first ring to form an upper loop, said upper loop encompassing the upper end of said sleeve;

said second band threaded through said second ring to form a lower loop, said lower loop encompassing the lower end of said sleeve whereby said strap transforms said sleeve into a tote bag.

* * * * *